US005755158A

United States Patent [19]

Wolfe et al.

[11] Patent Number: 5,755,158

[45] Date of Patent: May 26, 1998

[54] ALTERNATELY ENGAGEABLE, DUAL-STAGE CLEANING SYSTEM FOR LITHOGRAPHIC PRINTING PLATES

[75] Inventors: David Wolfe, Amherst; Samuel D. Zerillo, Hillsboro, both of N.H.

[73] Assignee: Presstek, Inc., Hudson, N.H.

[21] Appl. No.: 697,680

[22] Filed: Aug. 28, 1996

[51] Int. Cl.[6] ..... B41F 35/00

[52] U.S. Cl. ..... 101/424; 101/425

[58] Field of Search ..... 101/424, 423, 101/425; 15/102, 103.5

[56] References Cited

U.S. PATENT DOCUMENTS

| | | | |
|---|---|---|---|
| 3,737,940 | 6/1973 | Moestue et al. | 15/302 |
| 3,763,778 | 10/1973 | Sills et al. | 101/426 |
| 3,822,642 | 7/1974 | Grindeland | 101/425 |
| 3,983,813 | 10/1976 | Tani | 101/425 |
| 4,015,307 | 4/1977 | Kossak | 15/256.52 |
| 4,088,215 | 5/1978 | Bader | 400/56 |
| 4,095,240 | 6/1978 | Tsutsui | 346/163 |
| 4,265,705 | 5/1981 | Pyykkonen | 162/272 |
| 4,499,827 | 2/1985 | Takeuchi et al. | 101/425 |
| 4,667,597 | 5/1987 | Wright et al. | 101/425 |
| 4,704,963 | 11/1987 | Nishimura et al. | 101/425 |
| 4,775,869 | 10/1988 | Minowa | 346/76 PH |
| 4,826,539 | 5/1989 | Harpold | 134/10 |
| 4,872,416 | 10/1989 | Daniel et al. | 118/203 |
| 4,875,412 | 10/1989 | Wright et al. | 101/425 |
| 4,905,596 | 3/1990 | Kobler | 101/216 |
| 4,972,780 | 11/1990 | Gasparrini et al. | 101/217 |
| 4,986,182 | 1/1991 | Sawaguchi et al. | 101/423 |
| 5,010,819 | 4/1991 | Uribe et al. | 101/425 |
| 5,117,754 | 6/1992 | Nozaka et al. | 101/425 |
| 5,148,746 | 9/1992 | Fuller et al. | 101/142 |
| 5,152,220 | 10/1992 | Lindner et al. | 101/423 |
| 5,213,040 | 5/1993 | Mihori et al. | 101/424 |
| 5,245,925 | 9/1993 | Switall et al. | 101/423 |
| 5,251,348 | 10/1993 | Corrado et al. | 15/256.53 |
| 5,257,578 | 11/1993 | Jackson et al. | 101/425 |
| 5,265,537 | 11/1993 | Gasparrini et al. | 101/425 |
| 5,271,326 | 12/1993 | Ebina | 101/425 |
| 5,275,104 | 1/1994 | Corrado et al. | 101/425 |
| 5,303,652 | 4/1994 | Gasparrini et al. | 101/425 |
| 5,322,015 | 6/1994 | Gasparrini | 101/425 |
| 5,325,779 | 7/1994 | Ebina | 101/423 |
| 5,367,955 | 11/1994 | Hara et al. | 101/424 |
| 5,404,819 | 4/1995 | Hishinuma et al. | 101/423 |
| 5,408,930 | 4/1995 | Loos | 101/423 |
| 5,425,309 | 6/1995 | Saito et al. | 101/423 |
| 5,450,792 | 9/1995 | Gegenheimer et al. | 101/425 |
| 5,566,617 | 10/1996 | Durrnagel | 101/423 |
| 5,611,281 | 3/1997 | Corrado et al. | 101/423 |

FOREIGN PATENT DOCUMENTS

| | | |
|---|---|---|
| 60-92884 | 5/1985 | Japan . |
| 61-125871 | 6/1986 | Japan . |

*Primary Examiner*—Edgar S. Burr
*Assistant Examiner*—Anthony H. Nguyen
*Attorney, Agent, or Firm*—Cesari & McKenna, LLP

[57] ABSTRACT

Cleaning apparatus for lithographic printing plates includes a rotating elastomeric roller that contacts imaged plates, which are typically (although not necessarily) carried on a rotary cylinder, at a velocity different from the velocity (if any) of the plate. The roller may spin in the direction of, or opposite to, that of the cylinder and at substantially different speed. Typically, the apparatus is mounted proximate to the cylinder, circumferentially adjacent to the imaging system, and is retractable so as to be selectively engaged when imaging is complete. The apparatus may include, in addition to or in lieu of the elastomeric roller, a second retractable cleaning member for rubbing the imaged plate with a cleaning fluid. The second cleaning member may be an elongated cartridge having an absorbent towel exposed along one face thereof. A cleaning fluid is dispensed onto the towel by, for example, a spraying device. The cartridge is then extended to urge the towel against the printing plate as it rotates.

25 Claims, 4 Drawing Sheets

ALTERNATELY ENGAGEABLE, DUAL-STAGE CLEANING SYSTEM FOR LITHOGRAPHIC PRINTING PLATES

BACKGROUND OF THE INVENTION

1.Field of the Invention

The present invention relates to digital printing apparatus and methods, and more particularly to a system for cleaning lithographic printing members following digital imaging on- or off-press.

2.Description of the Related Art

In offset lithography, a printable image is present on a printing member as a pattern of ink-accepting (oleophilic) and ink-rejecting (oleophobic) surface areas. Once applied to these areas, ink can be efficiently transferred to a recording medium in the imagewise pattern with substantial fidelity. Dry printing systems utilize printing members whose ink-repellent portions are sufficiently phobic to ink as to permit its direct application. Ink applied uniformly to the printing member is transferred to the recording medium only in the imagewise pattern. Typically, the printing member first makes contact with a compliant intermediate surface called a blanket cylinder which, in turn, applies the image to the paper or other recording medium. In typical sheet-fed press systems, the recording medium is pinned to an impression cylinder, which brings it into contact with the blanket cylinder.

In a wet lithographic system, the non-image areas are hydrophilic, and the necessary ink-repellency is provided by an initial application of a dampening (or "fountain") solution to the plate prior to inking. The ink-abhesive fountain solution prevents ink from adhering to the non-image areas, but does not affect the oleophilic character of the image areas.

To circumvent the cumbersome photographic development, plate-mounting and plate-registration operations that typify traditional printing technologies, practitioners have developed electronic alternatives that store the imagewise pattern in digital form and impress the pattern directly onto the plate. Plate-imaging devices amenable to computer control include various forms of lasers. For example, U.S. Pat. Nos. 5,351,617 and 5,385,092 disclose an ablative recording system that uses low-power laser discharges to remove, in an imagewise pattern, one or more layers of a lithographic printing blank, thereby creating a ready-to-ink printing member without the need for photographic development. In accordance with those systems, laser output is guided from the diode to the printing surface and focused onto that surface (or, desirably, onto the layer most susceptible to laser ablation, which will generally lie beneath the surface layer).

Many kinds of plates imageable by laser or other recording instrument, and particularly those involving ablation mechanisms, generate debris. For example, some of the plates described in U.S. Pat. Nos. 5,339,737 and 5,379,698 include a topmost silicone layer, an underlying layer ablatable by laser discharge, and a strong, stable substrate beneath the ablation layer. Exposure of the plate to a laser pulse destroys the ablation layer, weakening the overlying silicone layer and de-anchoring it. The silicone layer is not, however, removed by imaging. Accordingly, after the plate has been fully scanned by the laser, the disrupted silicone must be removed by other means.

Various approaches have been suggested for removing plate debris produced in the course of platemaking, and specifically in connection with imaging processing involving ablation. One such cleaning system is disclosed in U.S. Pat. No. 5,148,746. Basically, that system comprises a rotating brush affixed to the writing head that can be moved into contact with the surface of the lithographic plate undergoing imaging. That system is also capable of delivering a cleaning fluid to the brush in order to help dislodge debris.

While that prior plate-cleaning apparatus operates satisfactorily in many respects, it is relatively slow because the brush cleans only a relatively small area of the plate at any given time. In other words, the brush head must be gradually moved along the entire length of the plate cylinder as it rotates in order to clean the entire surface of the plate.

Furthermore, with some plate constructions, that prior cleaning apparatus is not sufficiently effective in removing all of the debris from the plate. This is due to a variety of factors, including the construction of the brush head itself, which is typically comprised of bristles; the accumulation of debris on the brush without sufficient provision for continuous removal; and the inefficient cleaning action that can result when measures for mechanical dislodgment are combined with the use of a cleaning fluid.

DESCRIPTION OF THE INVENTION

Brief Summary of the Invention

We have found that continuous removal of the rubbery form of debris that attends imaging of silicone-containing plate constructions is efficiently facilitated through the use of a rotating elastomeric roller. The roller contacts the imaged plate, which is typically (although not necessarily) carried on a rotary cylinder, at a velocity different from the velocity (if any) of the plate. In a preferred approach, the plate is carried on a rotary cylinder, and the roller spins in the direction opposite that of the cylinder and at substantially higher speed. Alternatively, the elastomeric roller can spin in the same direction as the cylinder, but once again at a substantially different speed. Ideally, the apparatus of the present invention is mounted proximate to the cylinder, circumferentially adjacent to the imaging system, and is retractable so as to be selectively engaged when imaging is complete. The roller need not have an axial extent equal to the width of the plate, but of course is longer than the maximum image width.

The apparatus preferably also includes a second retractable cleaning member for rubbing the imaged plate with a cleaning fluid. Ordinarily this element of the invention will supplement the elastomeric roller, applying the cleaning liquid (which may be a solvent or a non-solvent for the plate surface) after the roller has completed its duty cycle. However, the benefits of automated application of cleaning fluid can be exploited for their own sake, and the retractable fluid-application member employed independent of the elastomeric roller.

In one embodiment, the second cleaning member is an elongated cartridge having an absorbent towel exposed along one face thereof. A cleaning fluid is dispensed onto the towel by, for example, a spraying device. The cartridge is then extended to urge the towel against the printing plate as it rotates. Towel material may originate on a supply roller, emerging from the interior of the cartridge body through a slot, wrapping around a portion of the exterior surface of the cartridge body and re-entering the interior through another slot, where it is taken up on an uptake roller. In this way, towel material may be advanced from the supply roller to the uptake roller through rotation thereof. Because the material applying the cleaning fluid to the plate is stationary (rather than rotating, as in the '746 patent), cleaning fluid is not scattered into the environment during use.

BRIEF DESCRIPTION OF THE DRAWINGS

The foregoing discussion will be understood more readily from the following detailed description of the invention, when taken in conjunction with the accompanying drawings, in which.

DETAILED DESCRIPTION OF THE PREFERRED EMBODIMENTS

Figure 1:
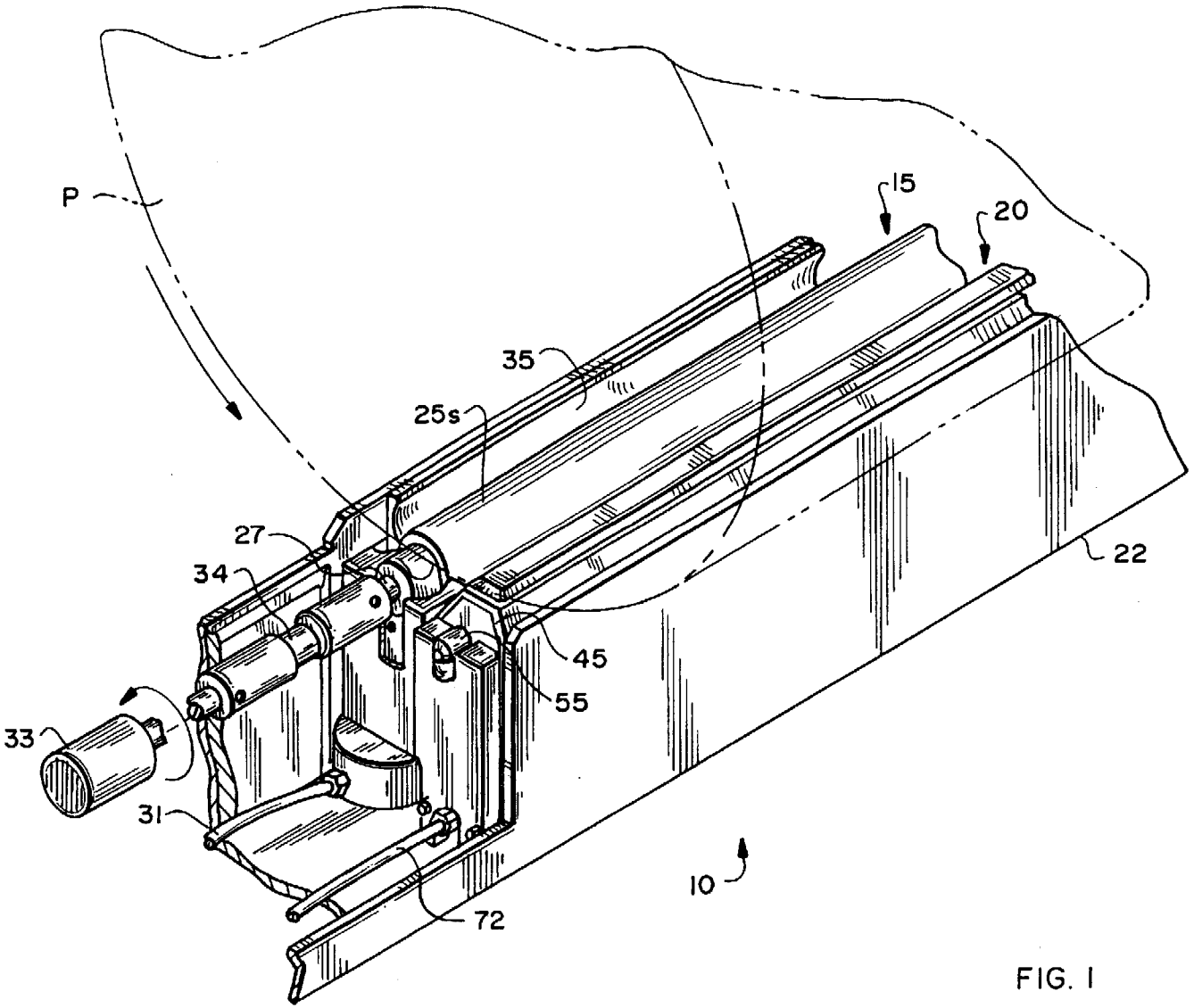
FIG. 1 is an isometric view of the present invention and its relationship in situ to a cylindrical plate-bearing member (shown in phantom), with the first cleaning element retracted and the second cleaning element raised.
Figure 2:
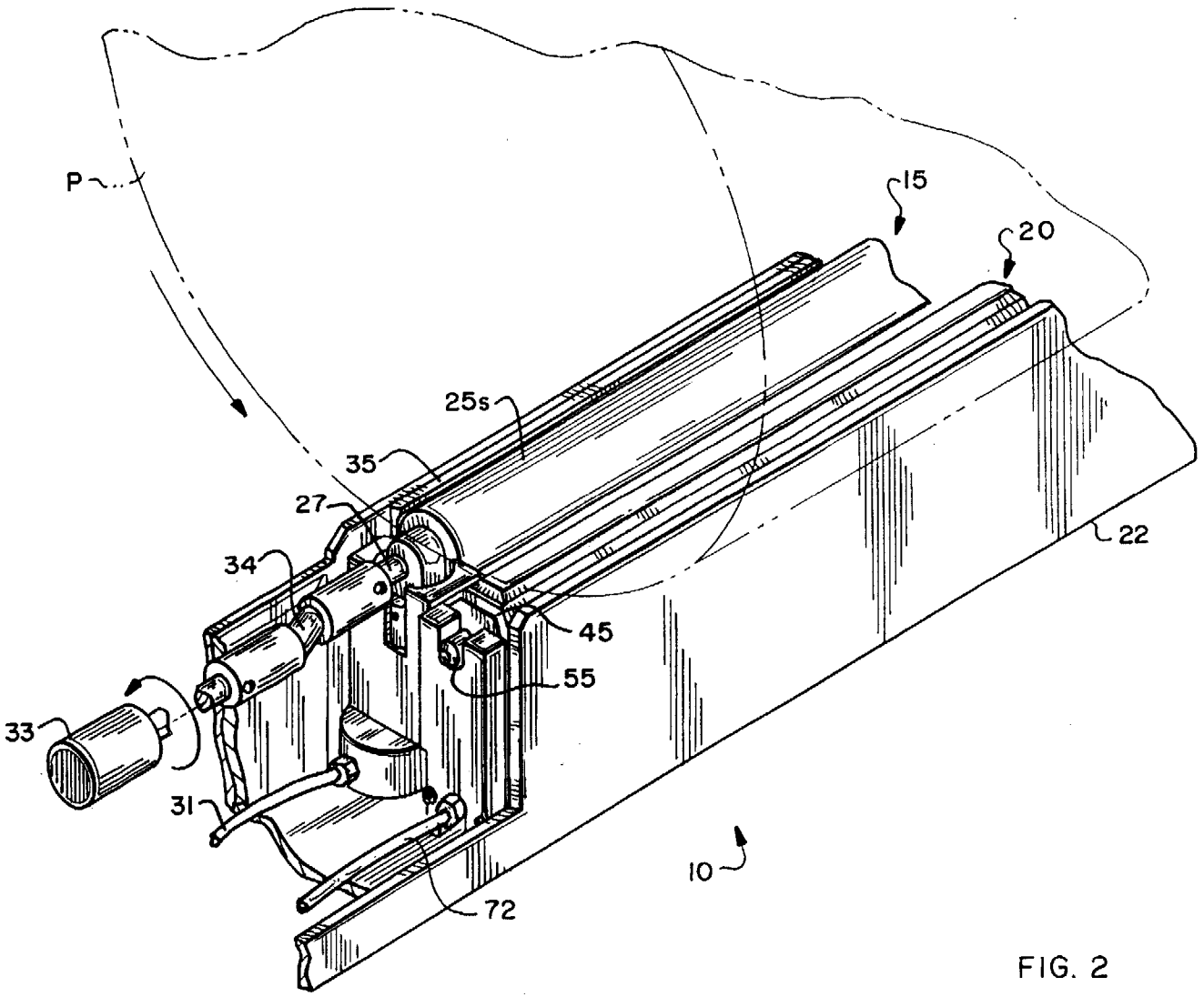
FIG. 2 is an isometric view of the present invention showing the first cleaning element raised and the second cleaning element retracted.

Refer first to FIGS. 1 and 2, which show the basic elements of a plate-cleaning apparatus in accordance with the invention, indicated generally at 10, and their relationship to a cylindrical plate-bearing member P. The member P may be, for example, the plate cylinder of a lithographic printing press, the plate-bearing support of a platesetter apparatus, or a seamless cylinder (e.g., the roll surface of a plate cylinder) which itself acts as a printing member that accepts ink in an imagewise pattern.

The cleaning apparatus 10 is disposed proximate to plate-bearing member P, and generally includes a pair of alternately engageable cleaning devices 15, 20, either of which can be raised to engage plate-bearing member P (or a plate wrapped therearound). Cleaning devices 15, 20 are carried on a frame 22. Elongated in dimension, both devices need not extend to both axial ends of plate-bearing member P, but should be longer than the maximum image width of the plates with which apparatus 10 is used. Frame 22 may be affixed to the machine frame of a printing press or platesetter by a set of spring-loaded fasteners, two of which are shown at 24 (see FIGS. 3 and 4).

Figure 3:
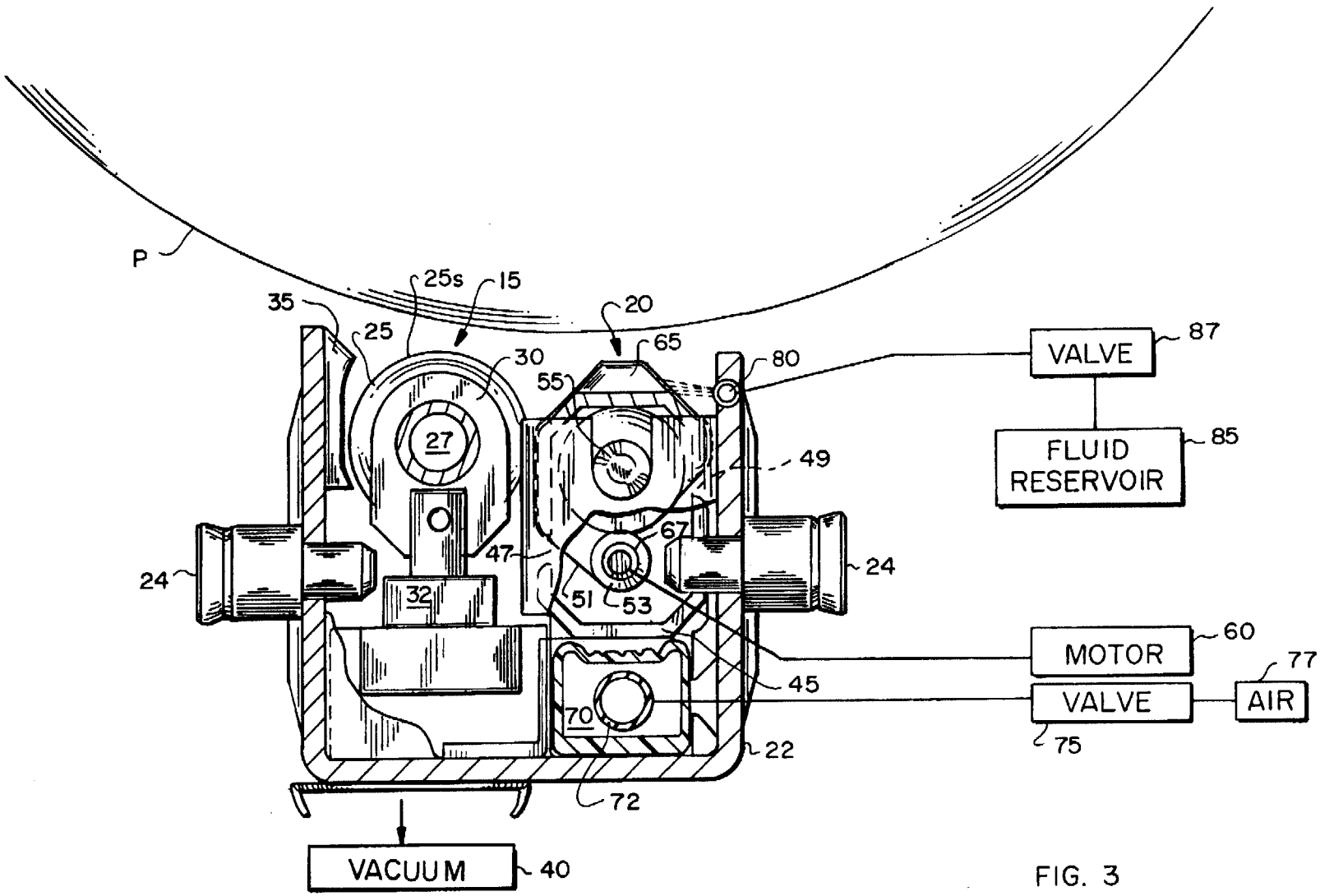
FIG. 3 is a partially schematic sectional elevation of the invention with parts cut away.
Figure 4:
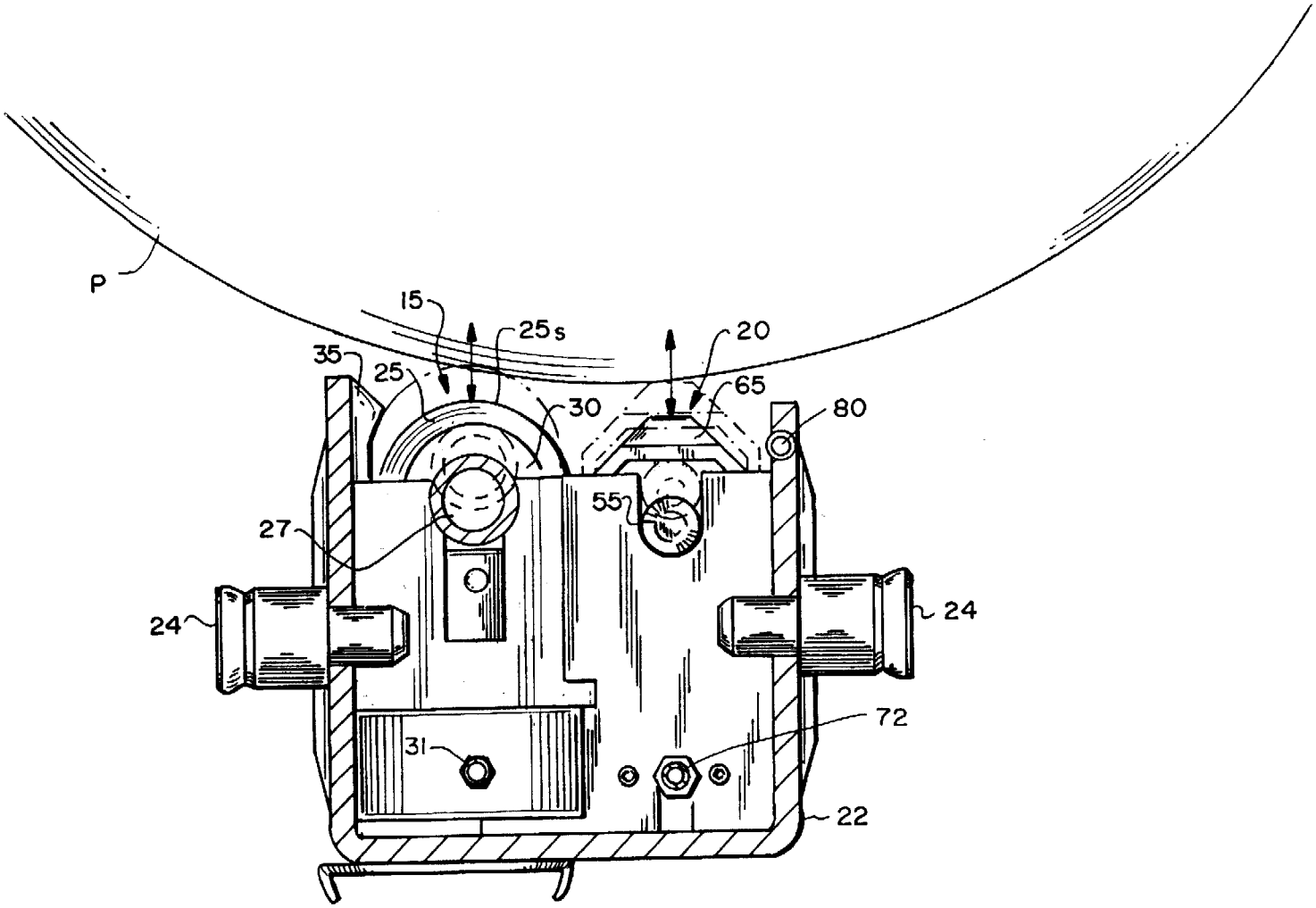
FIG. 4 is a sectional elevation of the invention showing extension and retraction of both cleaning stages.

With reference to FIGS. 1–3, it will be seen that cleaning device 15 comprises a generally cylindrical roller 25 having a soft, elastomeric surface **25*s* that will not scratch or abrade the printing plate. Suitable materials for surface 25*s* include polyurethane, elastomeric terpolymers of ethylene, propylene and diene monomers (i.e., so-called EPDM materials), silicone rubber and latex. Elastomeric surface 25*s* may be a solid or cellular (i.e., open-cell) polymer. Roller 25 terminates at each axial end in a shaft, one of which is shown at 27. Each shaft 27 is supported by a roller journal, one of which is shown at 30. Roller journals 30 are supported on identical air cylinders, one of which is shown at 32. The air cylinders are filled with air through a feed tube 31. As shown in FIG. 4, charging air cylinders 32 raises cleaning device 15 such that surface 25*s* is in contact with the surface of a plate on plate-bearing member P. A motor 33, coupled to roller 25 by a universal joint 34, rotates roller 25. Universal joint 34 facilitates the uninterrupted transmission of rotative force to roller 25** as it extends and retracts.

A doctor blade 35 is affixed to the interior surface of a wall of housing 22. The relative positions of doctor blade 35 and roller 25 are arranged such that the scraping edge of doctor blade 35 does not engage roller surface **25*s* when roller 25 is in the retracted position shown in FIGS. 1 and 3, but presses against that surface when roller 25 is extended as shown in FIGS. 2 and 4, removing debris collected by roller 25 as it cleans a plate. The bottom wall of housing 22 includes an elongated aperture, and a vacuum source 40 draws out of the apparatus debris dislodged by roller 25 and loosened from surface 25*s* by doctor blade 35. The debris ultimately accumulates on a filter, which is periodically cleaned or replaced, within vacuum source 40**.

The second engageable cleaning device 20 comprises a cartridge body 45 having a first slot 47 and a second slot 49 on opposing faces, and through which an absorbent towel material 51 passes. Towel material 51 originates on a supply roller 55, emerging from the interior of cartridge body 45 through slot 49, wrapping around the upper exterior surface of cartridge body 45 and re-entering the interior through slot 47, where it is taken up on an uptake roller 53. Uptake and supply rollers 53, 55 are journaled into the ends of cartridge 45. Towel material is advanced from supply roller 55 to uptake roller 53 by a motor 60, which engages uptake roller 53 by gears or other suitable means of transmitting rotative force. A one-way clutch 67 restrains backward rotation of roller 53, preventing the friction of the plate against the towel nip from pulling material from roller 53. A tension brake (not shown) on supply roller 55 prevents spurious unwinding of that roller during use.

Preferably, the top of cartridge body 45 is capped by an elastomeric pad or nip 65. The top edges of cartridge 45 are preferably beveled or rounded to avoid damage to towel material 51 as it advances around cartridge 45, and the outer edges of pad 65 are shaped consistently with the top edges of cartridge 45 to provide a continuous, smooth travel path. If appropriate, rollers or other suitable low-friction surfaces can be installed at each turn point in the towel advancement path to minimize tensions. By housing towel 51 within the interior of cartridge 45, this configuration protects towel 51 from contamination during handling and installation in a pressroom environment.

Cartridge 45 is supported within frame 22 by an air bladder 70 disposed on the floor of frame 22. Bladder 70 may be filled with air or other fluid via a pipe 72. In a preferred configuration, a solenoid-actuated valve 75 connects bladder 70 to a source 77 of pressurized air. When valve 75 is energized, bladder 70 is filled with air, urging cartridge 45 upward so that the towel material passing over pad 65 contacts the surface of a plate on plate-bearing member P (as shown in FIG. 4). When valve 75 is de-energized, the air in bladder 70 is vented to the atmosphere, lowering cartridge 45 to the rest position.

Preferably, the apparatus contains means for dispensing a cleaning fluid onto the portion of towel material 51 that makes contact with the plate. A preferred configuration includes a spraying bar 80 directed along towel 51 in advance of and proximate to its line of contact with a plate. Sprayer bar 80 is selectably fed by a fluid reservoir 85 via a valve 87. The cleaning fluid contained in reservoir 85 depends on the nature of the plate. In one approach, the cleaning fluid is a non-solvent for the surface of the plate. For example, in the case of silicone-surfaced dry plates described, the cleaning fluid may be isopropyl alcohol. In another approach, the cleaning fluid is a solvent for the surface of the plate; in the case of the just-mentioned dry plates, an aliphatic solvent such as VM&P naphtha may be used.

In operation, the plate is first fully imaged on plate-bearing member P. As plate-bearing member P continues to rotate, motor 33 is energized to rotate roller 25 at a velocity different from that of the plate-bearing member P. For example, roller 25 may rotate in the direction opposite that of plate-bearing member P. In a representative implementation, plate-bearing member P is the plate cylinder of a lithographic printing press, and rotates in the illustrated direction at 3.3 RPM; roller rotates in the opposite direction at 380 RPM. Air cylinders 32 are then actuated, lifting roller 25 so that its rotating surface 25*s* contacts the surface of the plate; rotative force is continually applied to roller 25 by means of universal joint 34. The rubbing action of the elastomeric surface 25*s* against that of the plate loosens and breaks free unremoved layer(s) from the imaged areas. For example, in the case of dry plates having a sandwiched ablation layer below a silicone surface layer, the present apparatus removes the disrupted portions of the silicone layer that overlie imaged plate regions. Airborne debris removed from the plate, as well as material scraped from surface 25*s* of roller 25 by doctor blade 35, is sucked from the apparatus by vacuum 40.

Following sufficient subjection of the plate to roller 25, air cylinders 32 are discharged, lowering cleaning device 15. With plate-bearing member P still rotating, valve 87 is actuated, causing spray bar 80 to eject cleaning fluid onto towel 51 just ahead of the (previously used) contact region above pad 20. Motor 60 is then actuated, advancing towel material around the travel path and onto roller 53. This action draws the just-moistened, unused region of towel 51 onto pad 20. Finally valve 75 is actuated, filling bladder 70 with air and lifting cartridge 45 so that the moistened contact region of towel 51 presses against the plate.

Following sufficient subjection of the plate to towel 51, bladder 70 is vented, lowering cleaning device 20. The plate is now clean and ready to accept ink.

The foregoing operations can be orchestrated, and the various components of the invention operated, by a suitable controller. This controller, the construction and programming of which is readily implemented by one skilled in the art, may be a separate unit or incorporated into the control section of a printing press or platesetter. Variations on the foregoing sequence of operations is also possible, depending on the application. For example, the cleaning process can be commenced before the plate has been fully imaged, if this is deemed useful. It may also be desirable some instances to simultaneously actuate devices 15, 20 rather than activating them sequentially, or to acuate devices 15, 20 in the opposite order, or to repeat the action of one or both devices. Towel material 51 can be advanced more than once for a single plate generating substantial debris, or, if the amount of debris is miniscule, the same region of towel material can be used for more than one plate. The apparatus can also be constructed with one or the other cleaning element 15, 20 but not both.

The cleaning apparatus 10 is versatile in that it is able to clean lithographic printing plates on- or off-press after imaging of the plate. Indeed, apparatus 10 can be operated even during printing, while the plate is receiving and transferring ink, in order to remove contamination from the plate after it is inked. The apparatus is compact and conveniently mounted within the larger press or platesetting apparatus with provision being made for quick coupling of the electrical, fluid and pneumatic connections.

The cleaning apparatus 10 is also quite efficient in that it spans the plate being cleaned and can thus clean the entire surface of the plate in the course of a few plate revolutions. Accordingly, the entire multiphase cleaning operation can be carried out in a minimum amount of time. Moreover, since dislodged material is constantly removed from the environment of the apparatus by vacuum, the apparatus can operate for a prolonged period of time without internal cleaning.

It will therefore be seen that we have developed a convenient and efficient approach to cleaning of lithographic printing plates, particularly those that have been imaged by an ablation process. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. Cleaning apparatus for cleaning a printing member associated with a rotary cylinder, the apparatus comprising:

a. a first elongated, retractable cleaning member extending substantially parallel to the cylinder and comprising a dry, elastomeric surface;

b. means for rotating the cleaning member at a velocity different from that of the cylinder;

c. means for extending and retracting the first cleaning member such that the first cleaning member, when extended, contacts the printing member;

d. a second elongated, retractable cleaning member extending substantially parallel to the cylinder, said member comprising means for carrying a cleaning fluid; and e. means for extending and retracting the second cleaning member such that the cleaning member, when extended, subjects the printing member to contact with the cleaning fluid.

2. The apparatus of claim 1 further comprising a doctor blade disposed so as to contact the first cleaning member when said member is extended.

3. The apparatus of claim 1 further comprising vacuum means for withdrawing debris from the apparatus.

4. The apparatus of claim 1 wherein the rotating means rotates the first cleaning member in a direction opposite rotation of the cylinder.

5. The apparatus of claim 1 wherein the rotating means rotates the first cleaning member in the same direction as the cylinder but at a different speed.

6. The apparatus of claim 1 wherein the means for extending and retracting the first cleaning member is a pneumatic actuator.

7. The apparatus of claim 1 further comprising vacuum means for withdrawing debris from the apparatus.

8. The apparatus of claim 1 wherein the means for carrying a cleaning fluid is a towel, and further comprising means for dispensing a cleaning fluid onto the towel.

9. The apparatus of claim 8 wherein the dispensing means is a sprayer.

10. The apparatus of claim 8 further comprising towel supply means and towel uptake means located within the second cleaning member, advancement of the uptake means withdrawing the towel from the supply means, the path from the supply means to the uptake means extending around a portion of the second cleaning member.

11. The apparatus of claim 10 further comprising means for periodically advancing the uptake means.

12. The apparatus of claim 10 further comprising means for restraining backward rotation of the uptake means.

13. Apparatus for cleaning a printing member rotatable at a velocity, the apparatus comprising:

a. a dry elastomeric cleaning member;

b. means for rotating the cleaning member in contact with the printing member and at a velocity different from the velocity of the printing member; and c. means for retractably biasing the cleaning member against the printing member.

14. The apparatus of claim 13 wherein the means for retractably biasing is a pneumatic actuator.

15. The apparatus of claim 13 wherein the printing member is associated with a rotary cylinder, the cleaning member being rotatable in a direction opposite rotation of the cylinder.

16. The apparatus of claim 13 wherein the printing member is associated with a rotary cylinder, the cleaning member being rotatable in the same direction as the cylinder but at a different speed.

17. The apparatus of claim 13 further comprising means for wiping the printing member with a cleaning fluid.

18. The apparatus of claim 17 wherein the wiping means comprises a towel at least a portion of which is suspended against an elastomeric surface, and further comprising means for retractably biasing the the suspended portion against the cleaning member.

19. The apparatus of claim 17 wherein the printing member has a surface and the cleaning fluid is a non-solvent for the surface.

20. The apparatus of claim 17 wherein the printing member has a surface and the cleaning fluid is a solvent for the surface.

21. A method of cleaning a printing member associated with a rotary cylinder, the method comprising:

a. rotating a dry elastomeric cleaning member against the printing member at a velocity different from that of the member; and b. wiping the printing member with a cleaning fluid.

22. The method of claim 21 wherein the printing member has a surface, the cleaning fluid being a non-solvent for the surface.

23. The method of claim 22 wherein the surface is silicone and the non-solvent is isopropyl alcohol.

24. The method of claim 21 wherein the printing member has a surface, the cleaning fluid being a solvent for the surface.

25. The method of claim 22 wherein the surface is silicone and the non-solvent is an aliphatic solvent.

* * * * *

UNITED STATES PATENT AND TRADEMARK OFFICE

CERTIFICATE OF CORRECTION

PATENT NO. : 5,755,158
DATED : May 26, 1998
INVENTOR(S) : Wolfgang Knecht et al.

It is certified that error appears in the above-identified patent and that said Letters Patent is hereby corrected as shown below:

Title page,
Item [75], Inventors, should read -- Wolfgang Knecht, Stuttgart (DE); Jörg Soldner, Ehningen (DE); Frank Vetter, Filderstadt (DE); Steven P. Meshenky, Rancine, WI; Robert J. Barfjnecht, Waterford, WI --

Signed and Sealed this

Twenty-fourth Day of August, 2004

JON W. DUDAS
*Director of the United States Patent and Trademark Office*

UNITED STATES PATENT AND TRADEMARK OFFICE

CERTIFICATE OF CORRECTION

PATENT NO. : 5,755,158
DATED : May 26, 1998
INVENTOR(S) : David Wolfe et al.

It is certified that error appears in the above-identified patent and that said Letters Patent is hereby corrected as shown below:

This certificate supersedes Certificate of Correction issued August 24, 2004, the number was erroneously mentioned and should be vacated since no certificate of correction was granted.

Signed and Sealed this

Eleventh Day of October, 2005

JON W. DUDAS
*Director of the United States Patent and Trademark Office*